US005826385A

United States Patent [19]

Dykstra et al.

[11] Patent Number: 5,826,385

[45] Date of Patent: Oct. 27, 1998

[54] PARTITION CONSTRUCTION WITH NOVEL REMOVABLE COVERS

[75] Inventors: Ronald A. Dykstra, Grandville; Russell P. Whitaker; Michael D. Elsholz, both of Grand Rapids, all of Mich.

[73] Assignee: Steelcase Inc., Grand Rapids, Mich.

[21] Appl. No.: 824,902

[22] Filed: Mar. 26, 1997

[51] Int. Cl.[6] ..... E04C 2/52

[52] U.S. Cl. ..... 52/220.7; 52/220.1; 52/239; 52/243; 52/36.6; 160/135; 160/351; 403/231; 403/375

[58] Field of Search ..... 52/239, 220.1, 52/220.7, 238.1, 243, 36.1, 36.6; 160/135, 351; 403/231, 230, 375

[56] References Cited

U.S. PATENT DOCUMENTS

| | | | |
|---|---|---|---|
| 2,312,580 | 3/1943 | O'Brien . | |
| 3,195,698 | 7/1965 | Codrea . | |
| 3,267,332 | 8/1966 | Bobrick . | |
| 3,316,624 | 5/1967 | Brudevold . | |
| 3,645,353 | 2/1972 | Cope et al. . | |
| 3,662,085 | 5/1972 | Robinson et al. . | |
| 3,812,450 | 5/1974 | Simovets, Jr. et al. . | |
| 3,856,981 | 12/1974 | Boundy . | |
| 3,909,912 | 10/1975 | Kiesling . | |
| 4,027,937 | 6/1977 | Norden . | |
| 4,056,297 | 11/1977 | Gartung . | |
| 4,066,838 | 1/1978 | Fujita et al. . | |
| 4,232,183 | 11/1980 | Person . | |
| 4,353,411 | 10/1982 | Harter et al. . | |
| 4,372,629 | 2/1983 | Propst et al. . | |
| 4,447,106 | 5/1984 | Houtz et al. . | |
| 4,451,106 | 5/1984 | Wiseheart et al. . | |
| 4,493,174 | 1/1985 | Arens . | |
| 4,497,356 | 2/1985 | Luck et al. . | |
| 4,685,255 | 8/1987 | Kelley . | |
| 4,717,358 | 1/1988 | Chaundy . | |
| 4,771,583 | 9/1988 | Ball et al. . | |
| 4,831,791 | 5/1989 | Ball . | |
| 4,863,398 | 9/1989 | Steenton et al. . | |
| 4,874,322 | 10/1989 | Dola et al. . | |
| 4,882,885 | 11/1989 | Chatterson et al. . | |
| 4,891,920 | 1/1990 | Pingston . | |
| 4,972,634 | 11/1990 | Dresden . | |
| 5,024,614 | 6/1991 | Dola et al. . | |
| 5,044,135 | 9/1991 | Kroon et al. . | |
| 5,172,529 | 12/1992 | Van De Riet . | |
| 5,209,035 | 5/1993 | Hodges et al. | 52/220.7 |
| 5,309,686 | 5/1994 | Underwood et al. . | |
| 5,383,318 | 1/1995 | Kelley et al. | 52/220.7 X |
| 5,394,658 | 3/1995 | Schreiner et al. . | |
| 5,406,760 | 4/1995 | Edwards . | |
| 5,478,032 | 12/1995 | Miller . | |
| 5,511,349 | 4/1996 | Kelley et al. | 52/220.7 X |
| 5,555,686 | 9/1996 | Bird et al. . | |
| 5,595,495 | 1/1997 | Johnson et al. . | |
| 5,638,650 | 6/1997 | Edwards | 52/239 |
| 5,670,743 | 9/1997 | Welch et al. | 52/220.7 X |
| 5,675,946 | 10/1997 | Verbeek et al. | 52/239 X |
| B1 4,224,769 | 5/1990 | Ball et al. . | |

*Primary Examiner*—Christopher Kent
*Assistant Examiner*—Yvonne Horton-Richardson
*Attorney, Agent, or Firm*—Price, Heneveld, Cooper, DeWitt & Litton

[57] ABSTRACT

A partition construction for subdividing a building space includes a partition frame having an open interior and defining a front side, a first cover covering a section of the partition frame with apertures for providing utility access, and a second cover slidably supported on the partition frame proximate the first cover. The second cover is slidable parallel the front side between a closed position covering the open interior and an open position providing access to utilities in the open interior. The second cover is semi-flexible so that it can be simultaneously slid along the partition frame and flexed away from the partition frame to a disengaged/removed position, thus allowing it to be removed even when the second cover is "trapped" on the partition frame by a furniture component attached to or positioned in front of the partition frame. A plurality of secondary covers are configured to snap attach to the first cover over the apertures, the secondary covers including a duplex receiving secondary cover, a telecommunication jack secondary cover, a flexible wire-routing secondary cover, and an aesthetic aperture-covering secondary cover.

36 Claims, 10 Drawing Sheets

PARTITION CONSTRUCTION WITH NOVEL REMOVABLE COVERS

BACKGROUND OF THE INVENTION

The present invention relates to a partition construction having removable covers adapted to provide access to utilities within the partition construction, even when the covers are partially covered or blocked by furniture components attached to or positioned in front of the covers, and to facilitate positioning and repositioning of utility outlets on the covers.

Office partitions are often provided with utilities, such as electrical power and telecommunication lines. It is advantageous to equip such partitions with covers that are removable so that the utilities therein can be easily accessed, such as to permit convenient routing and rerouting of wires, and to permit addition of new utilities. However, removable covers often become unremovable or "trapped" on their respective partitions by furniture components positioned in front of the removable covers. Such furniture components may be freestanding or attached to the partitions, and can include shelves, worksurfaces, cabinets, book binders, file carriers, attached or free standing furniture, computer equipment, and the like. The furniture components cause the job of accessing the utilities to become very time consuming to the repairman and very disruptive to the office worker because of the myriad of items in the way. The problem is particularly noticeable when the furniture component trapping the cover is heavy or is semi-permanently-attached, since such items require substantial effort to move them before the cover can be removed. For example, this problem occurs when a first partition is attached "off-module" to a second partition between the vertical side edges of the second partition. Unless the "off-module" partition is spaced away from the first partition, which is seldom done because of creating a visually unattractive gap, the vertical side edge of the "off-module" partition abuts the cover of the first partition, making it impossible to pull off and remove the cover until the "off-module" partition is first disconnected. But disconnection of the "off-module" partition is very difficult, inconvenient, and disruptive in an office environment, since binder bins, shelves, storage units, cabinets, and other furniture components are often attached to the partitions. The net result is that it becomes a major undertaking by a repairman to disconnect the "off-module" partition.

Another problem is that customers have different utility needs, resulting in requests for a myriad of different utility outlet arrangements along the beltway area. It is not economically feasible to custom build parts for every different possible arrangement that users will want.

Further, "too many" special/different parts for different arrangements leads to errors in filling out purchase orders, errors in shipping, installation errors and other difficulties. Even if an installation is successfully and properly set up, work requirements change, such that more or less outlets, jacks, and the like are often needed. In an attempt to quickly satisfy their needs, office workers will route wires as needed in and around the work area from existing outlets and jacks. This results in a nightmare of tangled wires, an unsightly mess, and a potential safety hazard.

Accordingly, a furniture construction solving the aforementioned problems is desired.

SUMMARY OF THE INVENTION

In one aspect, the present invention includes a partition construction including a partition frame having an open interior with utilities therein and a front side, and a removable cover covering a section of the partition frame. A cover support on the partition frame slidably supports the cover for movement parallel the front side between a closed position covering the open interior and an open position providing access to the utilities in the open interior.

In another aspect, a partition construction includes a partition frame having a front and an interior space with utilities therein. A first beltway cover is attached to the partition frame, the first beltway cover including a section with utility outlets therein. A second beltway cover is attached to the partition frame adjacent the first beltway cover. The second beltway cover is slidably attached to the partition frame and is moveable along the front to provide access to the utilities in the interior space and to provide access at a back of the first beltway cover.

In another aspect, a cover construction for covering a partition frame includes a first cover having a face adapted to receive utility outlets, a horizontal side edge and a front. A removable second cover has a second horizontal side edge configured to matingly engage the first horizontal side edge. The second cover slidably engages the first horizontal side edge so that the second cover can be disengaged from the first cover by sliding the second cover along the face to a disengaged position to provide access to utilities behind the first cover.

These and other features and advantages of the present invention will be further understood and appreciated by those skilled in the art by reference to the following specification, claims, and appended drawings.

DETAILED DESCRIPTION OF PREFERRED EMBODIMENT

Figure 1:
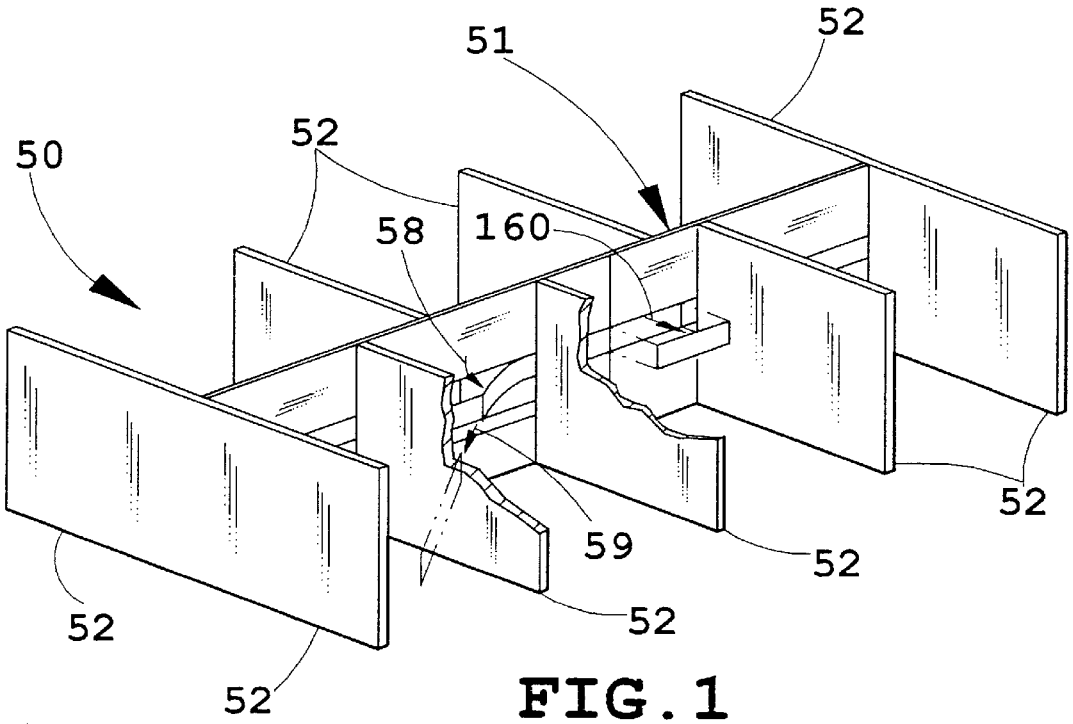
FIG. 1 is a perspective view of an arrangement of partitions embodying the present invention.

For purposes of description herein, the terms "upper", "lower", "right", "left", "rear", "front", "vertical", "horizontal", and derivatives thereof shall related to the invention as oriented in FIG. 1 with a person facing the partition panel of interest. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A partition construction 50 embodying the present invention is shown in an office environment in FIG. 1. Nonetheless, it is specifically contemplated that the present invention can be successfully used in many different environments, especially where a removable cover is likely to be "trapped" on a partition or wall by a furniture component positioned in front of or attached to the partition. Such conditions can and do occur in factory environments, in domestic sites, and in other locations where furniture may be used. The term "trapped" is used herein to describe a situation wherein a removable cover covering a partition frame cannot be removed in a direction generally perpendicular to a front of the partition frame due to a furniture component that physically occupies the space immediately in front of and adjacent the partition frame. Thus, the furniture component interferes with and prevents the cover panel from being lifted off of the front of the partition, i.e. trapping the cover on the partition frame.

An exemplary partition system that can be used with the present cover system is disclosed in detail in copending, coassigned patent application Ser. No. 08/701,664, filed Aug. 22, 1996, entitled RECONFIGURABLE SYSTEM FOR SUBDIVIDING BUILDING SPACE AND HAVING MINIMAL FOOTPRINT, and in copending, coassigned patent application Ser. No. 08/767,814, filed Dec. 17, 1996, entitled PARTITION CONSTRUCTION, the entire contents of both of which are incorporated herein in their entirety by reference. In those partition systems, as described below, the partition frames are configured to support other partition frames perpendicularly thereto in any one of a plurality of different intermediate "off-module" locations between their vertical side edges. Advantageously, this allows the partition frames to be selectively configured and reconfigured into different office arrangements, where the offices have different sizes, shapes and numbers, but where the same partition frames and partition covers are used. For example, FIG. 1 shows an office arrangement wherein five perpendicular partitions are attached to one side of a main run of partitions to form four offices, and four additional perpendicular partitions are attached to the other side to form three larger offices. It is to be understood that any or each of the offices on either side can be selectively made larger or smaller, and can be made to have different sizes and shapes, merely by selective rearrangement and reattachment of the existing partitions. Notably, in the partition arrangement shown in FIG. 1, several of the perpendicular partitions have ended up in "off-module" locations where they interfere with removing the covers off of the face of the partitions in the main run of partitions. Thus, removable covers on the main run of partitions cannot be pulled perpendicularly off of the face of the main run of "spine wall" partitions. The present cover system solves this problem by allowing its covers to slide along the face of the main run of partitions, and to flex during the sliding. Thus, covers that would otherwise be "trapped" by "off-module" partitions, can be removed even while the perpendicular "off-module" partitions are still attached to the main run of "spine wall" partitions.

It is further contemplated that the present cover system can be used to cover a permanent architectural wall, a demountable architectural wall, or other space dividing wall structure where there is a need to access an interior of the wall, but where items may block removal of the covers.

Specifically in regard to FIG. 1, partition construction 50 includes a main run of partitions 51 (sometimes called a "spine" wall), and a plurality of perpendicularly attached partitions 52 (sometimes called a "fin" wall). The partitions 51 and 52 can have identical partition frames, or can be different partition frames. For example, it is contemplated that the partitions making up the "spine" wall will have a high degree of utility carrying capability, while the "fin" wall partitions may have a lesser utility carrying capability, depending on the functional requirements of the customer. It is contemplated that the same covers can be used on partitions of the "spine" wall and the "fin" walls, although this need not be the case. As illustrated in FIG. 1, the partitions 51 include a generic lower cover 53, a generic upper cover 54, and a pair of beltway covers 56 and 57 located immediately above the worksurface height. The arrow 58 shows the resilient flexibility of the upper beltway cover 57, and the arrow 59 shows the direction of flexing/sliding movement that allows the upper beltway cover 57 to slide out from under an off-module connected partition 52 forming a "fin" wall.

Figure 2:
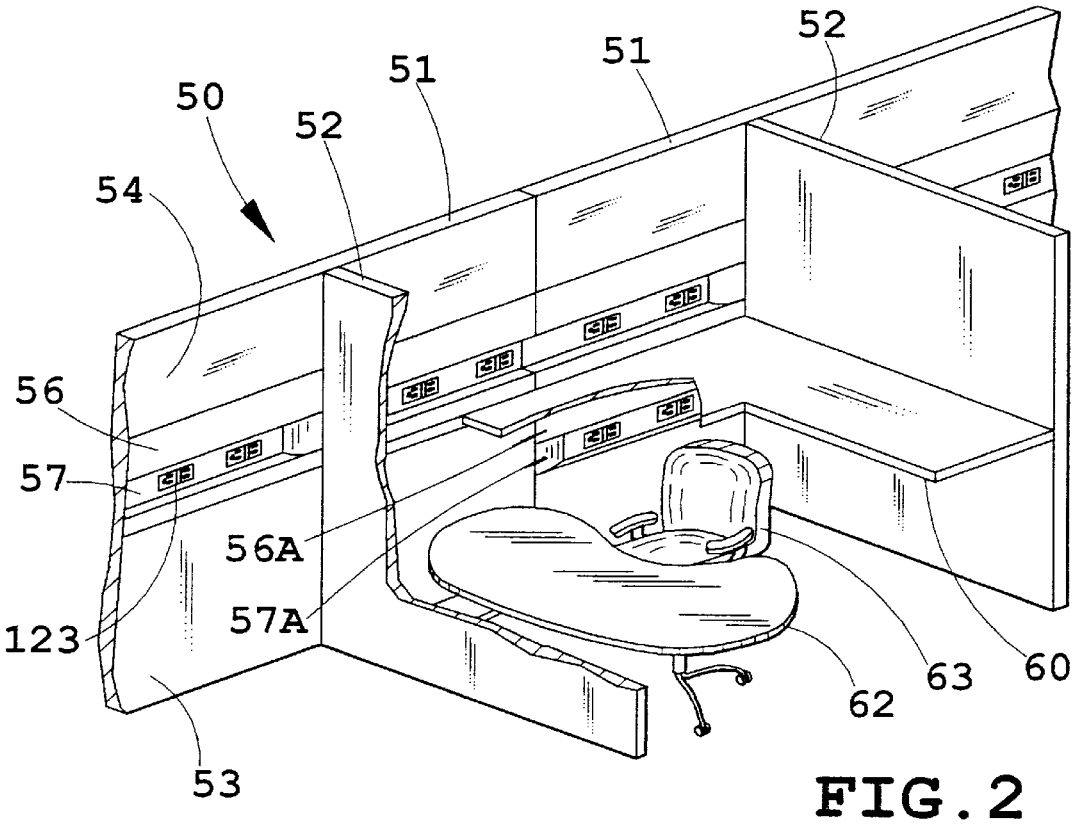
FIG. 2 is an perspective enlarged view of a particular one of the offices shown in FIG. 1, the office being formed by a main run of partitions forming a spine wall, and two partitions attached off-module to the main run of partitions.

FIG. 2 illustrates that the present system can be used at different heights along partitions, and in particular can be used both above and below a worksurface. Specifically in FIG. 2, an L-shaped corner-positioned worksurface 60 is attached to the partitions 51 and 52, and extends around an inside corner formed by the partitions 51 and 52. A pair of beltway covers 56 and 57 are shown attached to the partition 51 above the worksurface 60, and a second pair of beltway covers 56A and 57A are attached to the partition 51 below the worksurface 60. It is noted that the beltway covers 56A and 57A are illustrated as extending only about half of the distance between the two fin wall partitions 52. Of course, the covers 56A and 57A could be extended a greater or lesser distance, and can themselves be "on-module" or "off-module" with respect to frame 79. Notably, it is contemplated that covers 56, 57, 56A, and 57A can be made from polymeric materials, sheet metal, composite materials, combinations thereof, or other structural materials having sufficient structural strength and fire resistant properties.

The office arrangement can include a variety of different furnishings, and it is these furnishings that can complicate removing the covers. The office arrangement of FIG. 2 includes a moveable table 62 and a chair 63, which items cause some difficulty but can be readily moved. Notably, removing the worksurface 60 and the fin wall partition 52 is more time consuming and disruptive, especially if there are papers and materials thereon.

Figure 3:
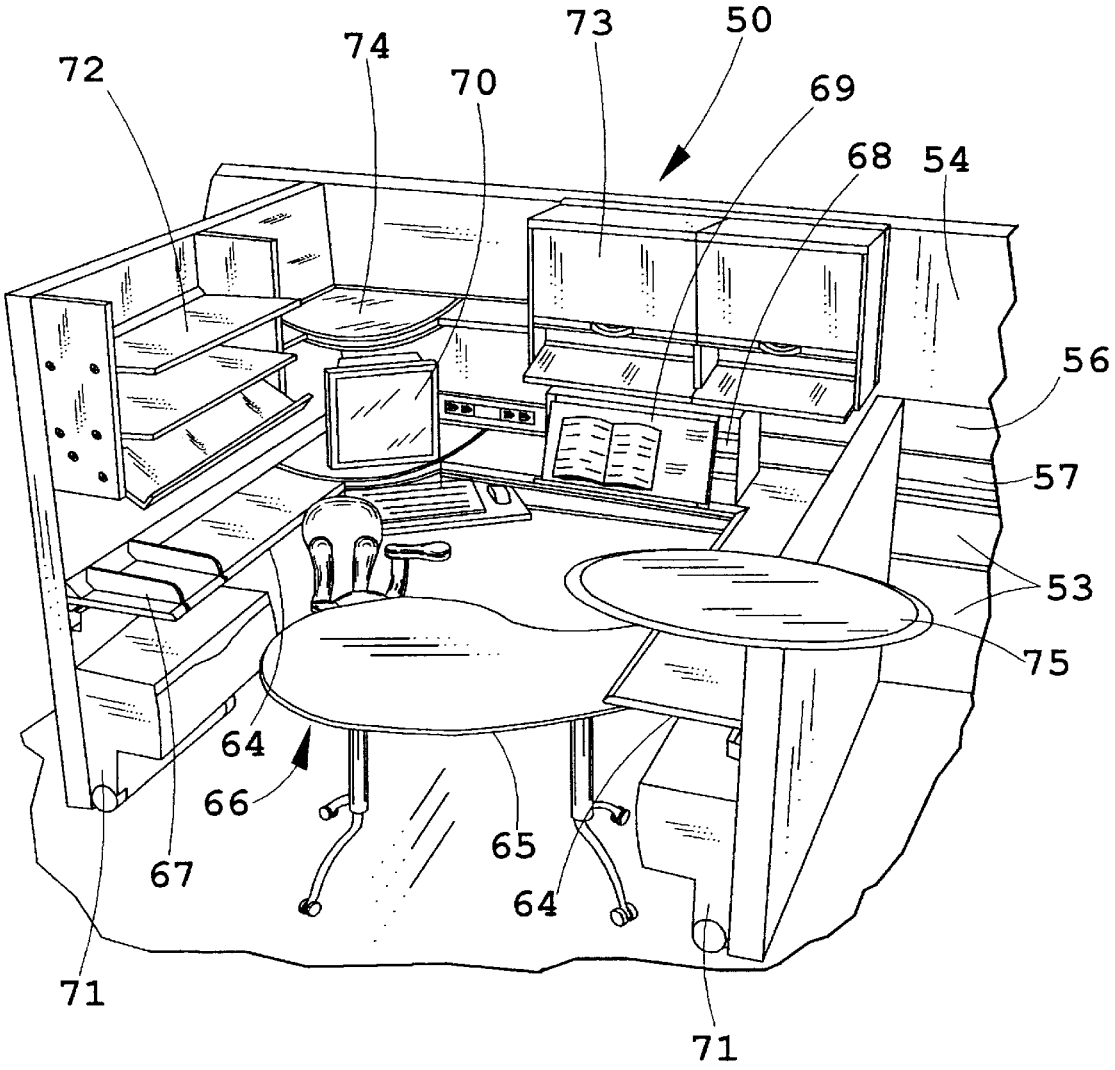
FIG. 3 is a perspective view of the office shown in FIG. 2, but with the office being furnished for intensive paper handling and computer work.
Figure 4:
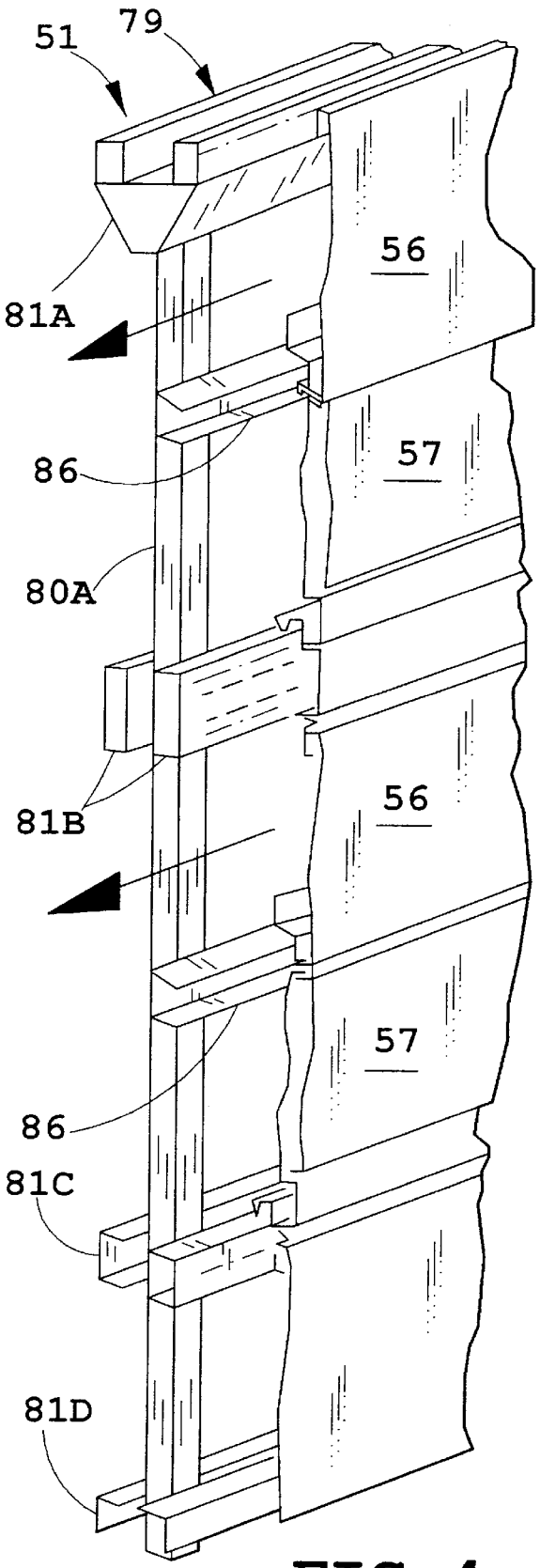
FIGS. 4 and 5 are an exploded fragmentary perspective view and an end view of the spine wall partition shown in FIG. 2.
Figure 5:
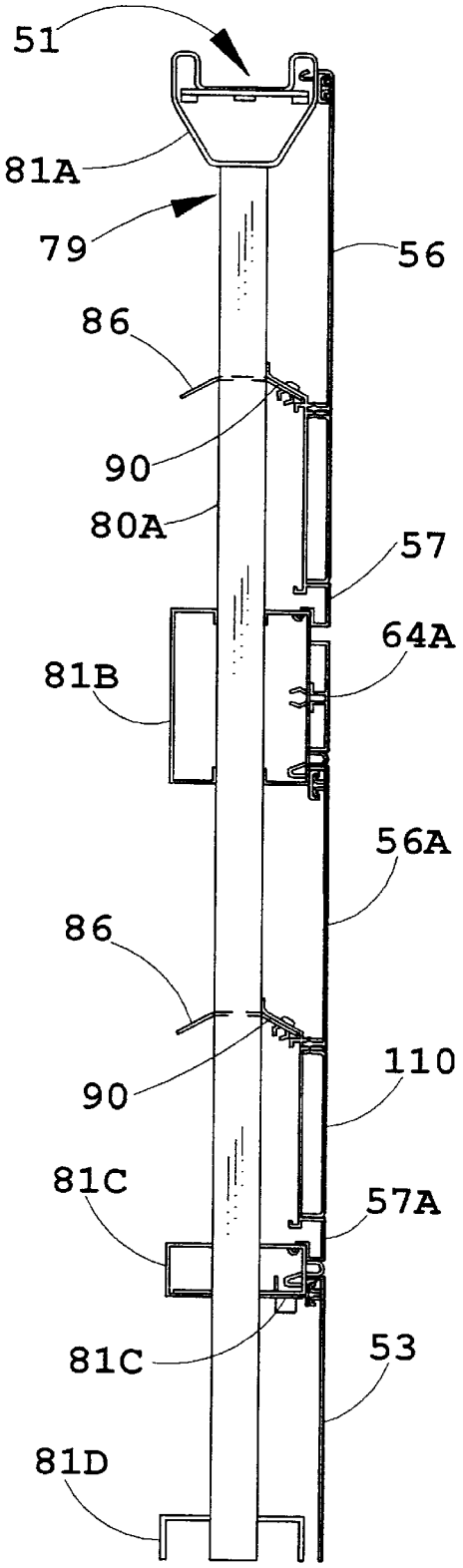
Figure 6:
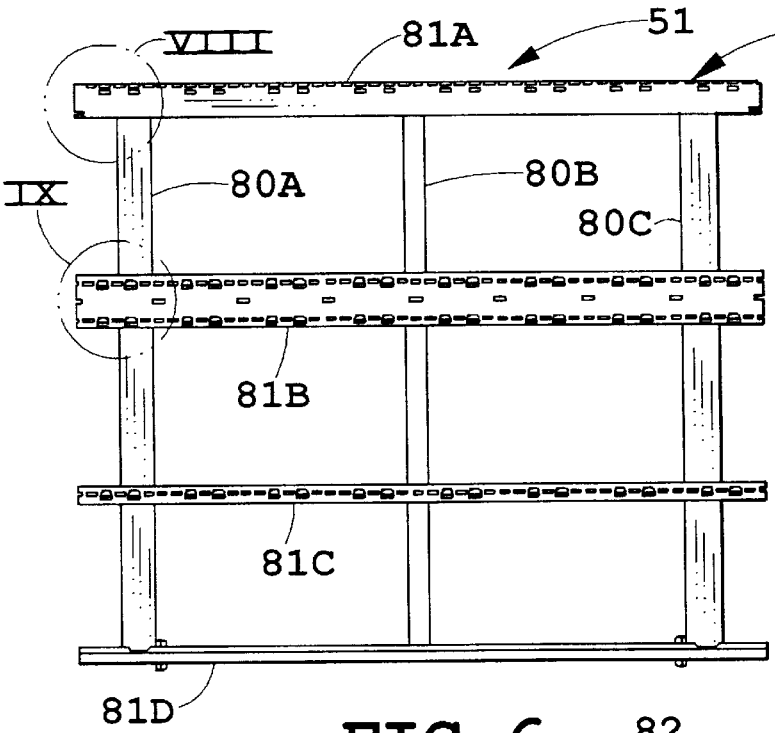
FIGS. 6 and 7 are front and end elevational views of the partition frame used in the partitions of FIGS. 1 and 2 to form the offices.
Figure 7:
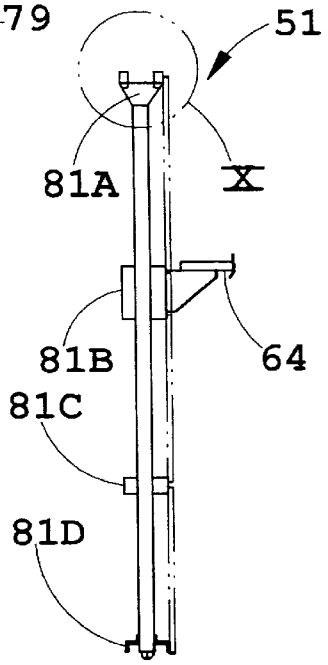
Figure 8:
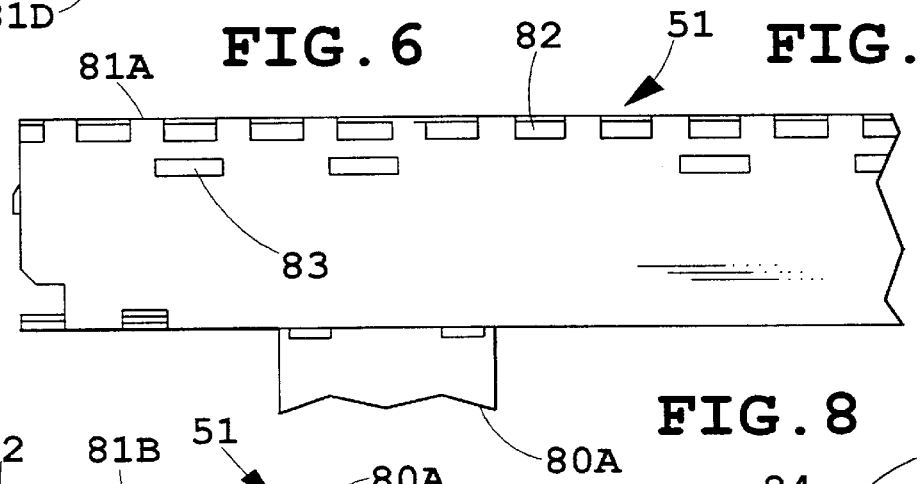
FIGS. 8–10 are enlarged views of the circled areas VIII, IX, and X in FIGS. 6 and 7.
Figure 9:
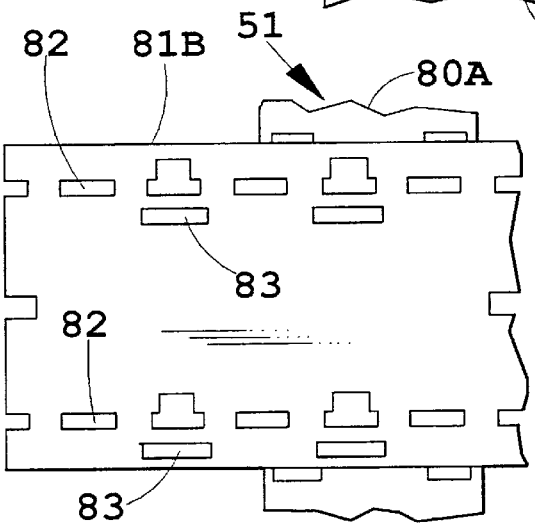
Figure 10:
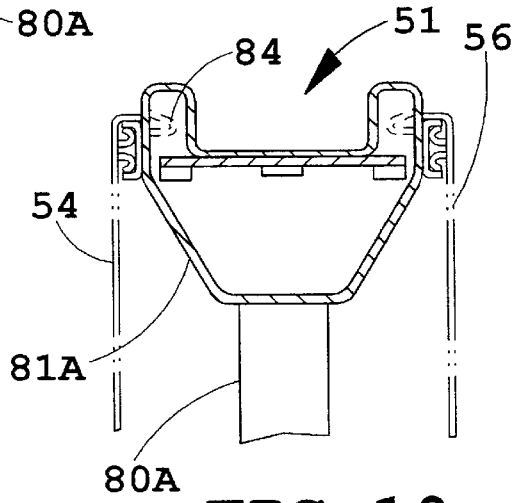

The office arrangement of FIG. 3 shows a paper intensive office arrangement with significant paper and file storage capability. This office arrangement includes a shelf 64 located just above the worksurface 65 of a mobile work table 66, and a plurality of items on the shelf 64 including a paper tray 67, a pigeon hole storage unit 68, a book support 69, and a computer display tube 70. Also attached to the partitions 51 and 52 are lower storage cabinets 71, upper shelves 72, book binder 73, corner shelf 74, and transaction table top 75. This office arrangement illustrates how disruptive and inconvenient having to disassemble and disconnect an "off-module" partition panel can be. For example, if one of the partitions 52 forming the fin wall needs to be removed from the office of FIG. 3, then substantially all of the items attached to or positioned next to the partition of the fin wall must first be removed. Also, even before that, all papers and other materials must be moved so that they do not fall or become disturbed during the procedure to remove the cover.

FIGS. 4–10 show the partition panel 51 in greater detail. Partition 51 includes a frame 79 (FIG. 6) comprised of a plurality of uprights 80A, 80B, and 80C welded or fixedly secured together with horizontal frame members 81A–81D. More (or less) uprights and horizontal frame members can be added (or subtracted) as the size of the partition is changed. The details of the uprights and horizontal frame members are discussed in detail in the application Ser. No. 08/767,814, previously incorporated herein by reference. It is sufficient for purposes of the present disclosure to understand that the horizontal frame members 81A–81D include planar outer faces with apertures 82 and 83 therein. The apertures 82 extend in a row across their respective horizontal frame members and provide a plurality of attachment sites for selectively attaching furniture components to the frames. Pairs of the apertures 83 are spaced across several of the horizontal frame members 81A–81D at regular intervals, such as every six inches. The apertures 83 are configured to receive connectors or clips 84 on the back of the quick-attach aesthetic covers 54. Covers 54 are aesthetically covered, painted, or treated, and may include sound deadening materials or other materials/constructions to provide other properties as desired. The aesthetic covers 54 include spring clip connectors 84 for quick attachment generally perpendicularly into the apertures 84 on the face of frame 79. The center horizontal frame member 81B (FIG. 9) has a longer vertical dimension than the other horizontal frame members, and is configured to support the cantilevered interactive intensive-use shelf 64 (FIG. 7) located immediately above the worksurface generally at a belt-high height. A cover 64A snap attaches to horizontal frame member 81B to cover the central portion thereof. It is contemplated that the beltway covers 56 and 57 will be located immediately above horizontal frame member 81B and that the beltway covers 56A and 57A will be located immediately below horizontal frame member 81B, although the covers can be located at any convenient or desired height along the partition. It is also contemplated that the present covers can be attached to a permanent or demountable/movable architectural wall.

Figure 13:
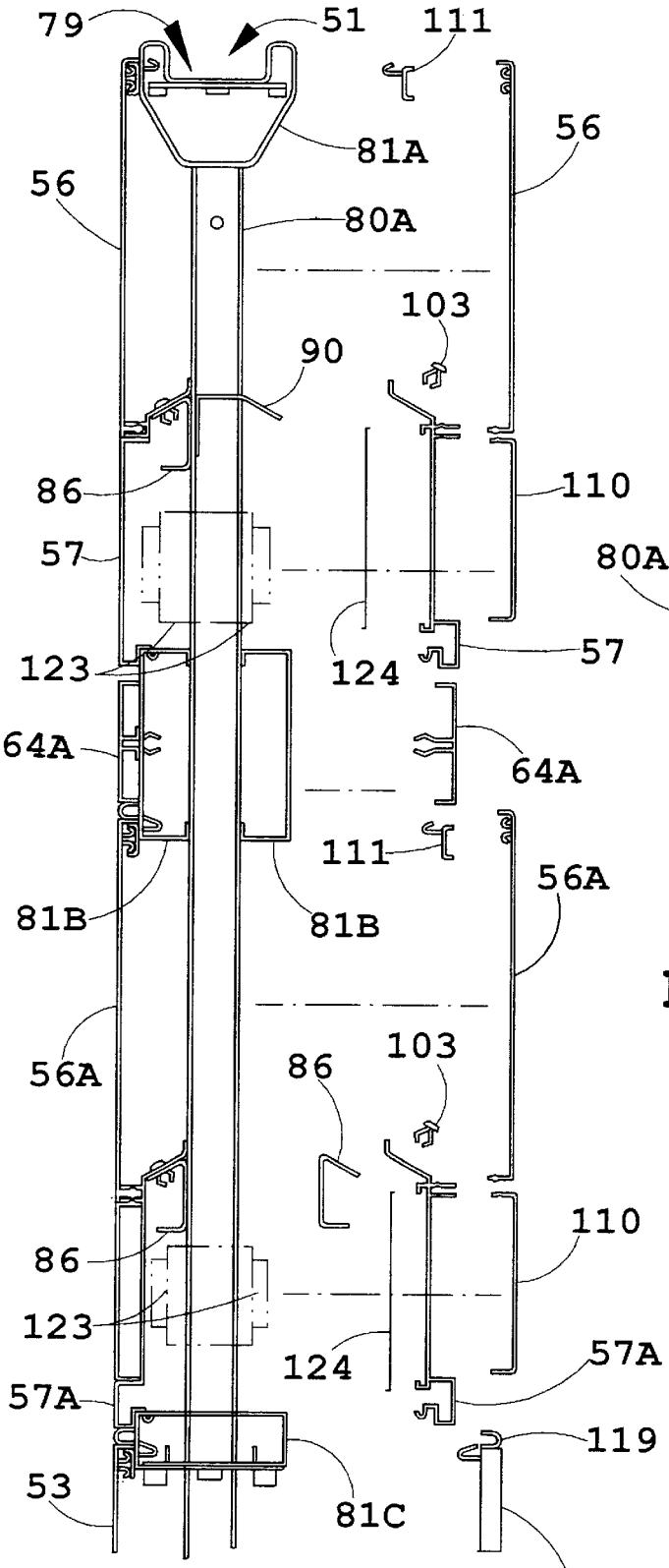
FIG. 13 is a partially exploded end view of the partition shown in FIG. 5.
Figure 14:
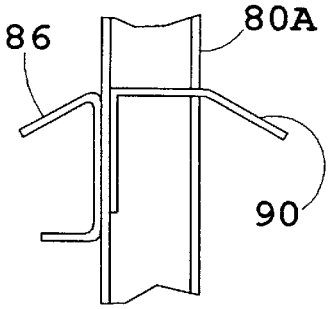
FIG. 14 is an enlarged fragmentary end view of the cover supporting bracketry attached to the partition frame, as shown in FIG. 13.
Figure 18:
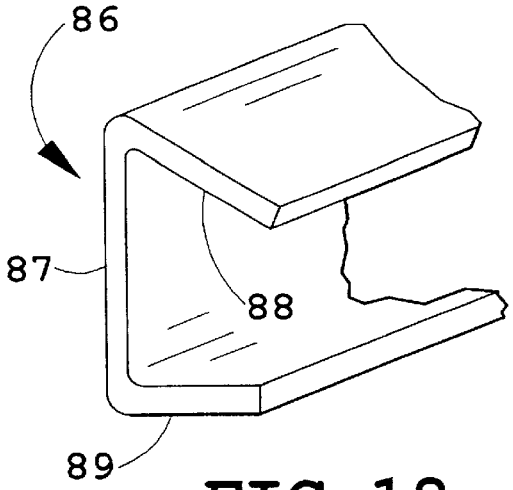
Figure 19:
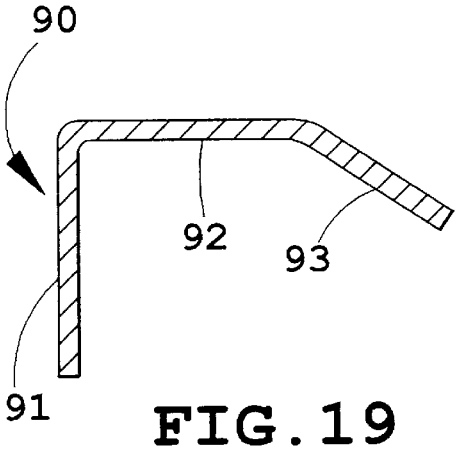
FIGS. 19 and 20 are side and perspective views of an L-shaped bracket shown in FIG. 11 attached to the C-shaped bracket for supporting beltway covers thereon.
Figure 20:
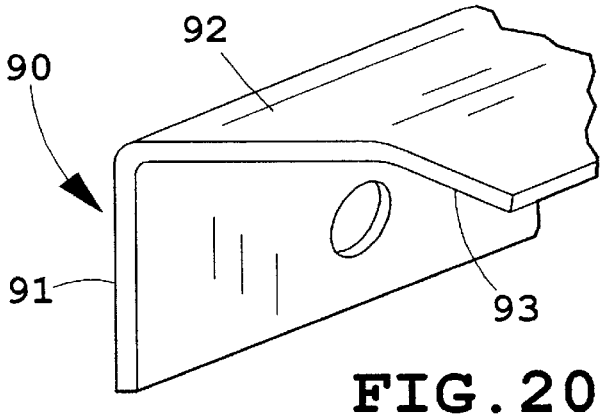

The present beltway cover system (FIG. 13) includes a C-shaped roll-formed bracket 86 (FIG. 18) having a flat side wall 87 attached to a front side of uprights 80A–80C at a location above horizontal frame member 81B. In the illustrated frame of FIG. 13, the bracket 86 is located between horizontal frame members 81A and 81B, although it is contemplated that the covers could be positioned anywhere on the frame 79. The C-shaped bracket 86 (FIG. 18) includes an angled upper leg 88 and a perpendicular lower leg 89, both of which strengthen and rigidify the bracket 86 as it spans between adjacent uprights 80A–80C. C-shaped bracket 86 extends the width of the frame 79, and is adapted to support an upper edge of the beltway cover 57 as described below. It is contemplated that a second C-shaped bracket 86 will be attached to the uprights on an opposite side of the partition frame 79. Alternatively, an L-shaped bracket 90 (FIGS. 14 and 20) can be used instead of a second C-bracket 86. L-shaped bracket 90 includes a leg 91 for attachment to the inside of flat side wall 87 and a transversely extending leg 92. An angled leg 93 extends from transversely extending leg 92, for supporting an upper edge of a second beltway cover 57 on an opposite side of the partition panel 79. Advantageously, the L-shaped bracket 90 need only be a few inches long, and it need not span the entire width of the partition frame 79 since it is supported by C-shaped bracket 86. This saves weight and material costs. When attached, the angled legs 88 and 93 have profiles that are mirror images of each other when the frame 79 is viewed from a vertical side edge. The angled legs 88 and 93 extend at about 30 degrees from horizontal downwardly and outwardly from frame 79.

The lower beltway cover 57 (FIG. 15A) is an extruded or roll-formed member that includes a panel body 94, a configured lower edge section 95 and a configured upper edge section 96. The lower edge section 95 includes a horizontally extending wall 97 that extends from the bottom of panel body 94, and a vertically extending lower wall 98 that extends from horizontal wall 97 and that is constructed to be located flush with the outer surface of aesthetic covers 53. A Z-shaped wall section 99 extends inwardly from flush lower wall 97. A plurality of spaced apart resilient integral clips 100 are formed along the inner edge of Z-shaped wall section 99 by cutting away longitudinal sections of the extension to form ¾ wide clip sections. Clips 100 are pointed and extend downwardly, and are shaped to snappingly frictionally engage upwardly open apertures 101 (FIG. 15) in the top of the horizontal frame member 81B. When attached, the middle flange 99A of the Z-shaped wall section 99 clears the outer side wall of the horizontal frame member 81B, although it is noted that it could be constructed to abut the frame member 81B to further stabilize the arrangement. It is contemplated that the wall section 99 could also rest on the top of horizontal frame member 81B if desired. The configured upper edge section 96 includes an angled flange 102 adapted to lie flat against the angled leg 88 (or angled leg 93), and a leg 102A for engaging a side of uprights 80A–80C. The angled flange 102 is attached to angled edge section 96 by a spring clip, screw, or other fastener 103 at multiple locations across the width of the frame 79.

Figure 15:
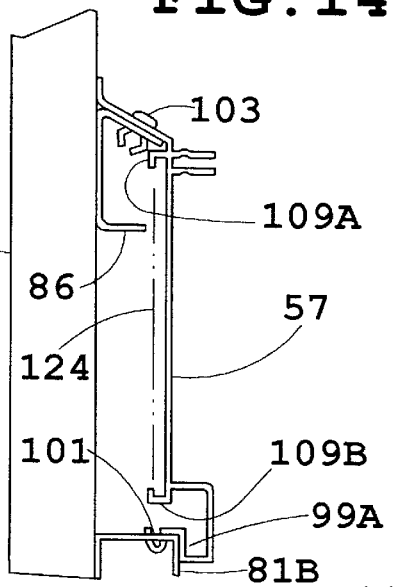
FIGS. 15 and 15A are end views of the lower beltway cover shown in FIG. 13, FIG. 15 showing attachment to a partition frame.
Figure 16:
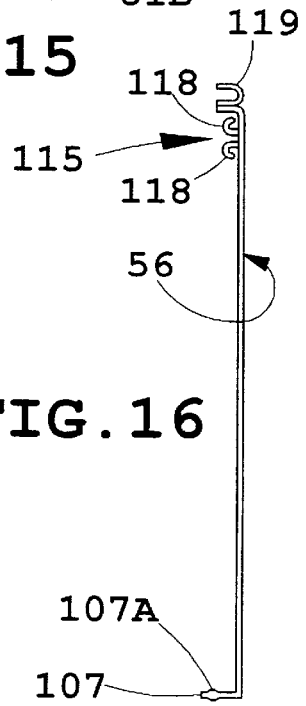
FIGS. 16 and 16A are end views of the upper beltway cover shown in FIG. 13, FIG. 16 showing attachment to a partition frame.

A pair of closely spaced flanges 104 and 105 (FIG. 15) are formed on a bottom of configured upper edge section 96 of cover 57 adjacent body panel 94. Flanges 104 and 105 extend outwardly. Flanges 104 and 105 define a space 106 for closley receiving a bottom connector flange 107 on upper beltway cover 56 (FIG. 15). The flanges 104 and 105 include one or opposing recesses for engaging mating ridges 107A on bottom connector flange 107, to securely frictionally retain the top cover 56 to bottom cover 57. The arrangement allows the cover 56 to be snappingly engaged with cover 57 either perpendicularly or slidingly from an end (see FIG. 16A). The bottom surface of lower flange 105 (FIG. 15A) and the top surface of transverse connecting wall 97 define a recess 108 for presenting utility outlets across the lower beltway cover 57. Opposing depressions 109 and 109A are formed in flange 105 and wall 97, respectively. A concavely shape trim shoe 110 (FIG. 32) is shaped to fit into recess 108 (FIG. 15A) and snappingly frictionally engage depressions 109. Opposing top and bottom rearwardly-extending attachment flanges 109A and 109B form a retention means for securing secondary cover panels to the beltway cover 57, as described below.

Figure 21:
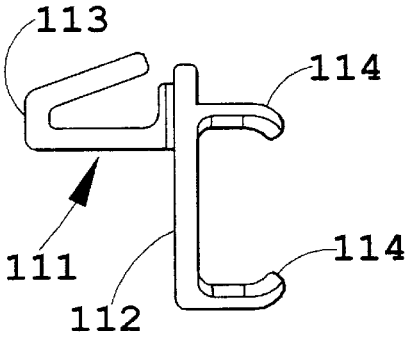
FIGS. 21–23 are side, front, and top views of a frame-engaging clip for supporting an upper beltway cover.
Figure 22:
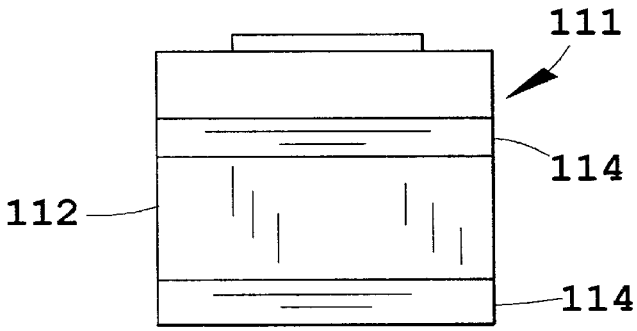
Figure 23:
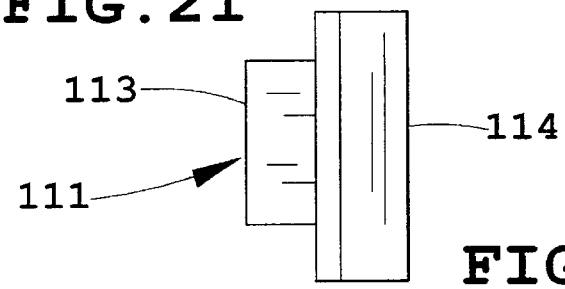

A frame-engaging clip 111 (FIGS. 21–23) includes a foot or plate section 112, and a resilient finger 113 that extends from plate section 112. Finger 113 is shaped to snap into and frictionally engage a selected aperture 83 in frame 79 so that it holds the plate section 112 against the front of the horizontal frame member 81A (or 81B–81D). A pair of resilient fingers 114 extend outwardly from plate section 112 in a direction opposite finger 113. The fingers 114 are deformed slightly toward each other at their ends to form jaws for gripping a "rose-bud" shaped mating connector 115 (FIG. 16) on the upper beltway cover 56.

Upper beltway cover 56 (FIG. 16) is a flexible extruded member that includes a panel body 116 with top and bottom edge flanges 117 and 107. As previously described, edge flange 107 is adapted to fit into the space 106 and frictionally engage flanges 104 and 105 to hold the bottom of upper beltway cover 56 to lower beltway cover 57. Rosebud-shaped connector 115 is integrally formed on panel body 116 at a location proximate its upper end but below upper edge flange 117. Connector 115 includes a pair of oppositely curled fingers 118 shaped to securely snappingly engage the fingers 114 on clips 111 positioned horizontally on frame 79. Advantageously, the connector 115 engages clip 111 in a novel manner that allows the connector 115 to be snapped into clip 111 perpendicularly from a front of the clip 111, or to be slid longitudinally along the face of frame 79 into engagement (or disengagement) with the clip 111. This allows the movement along arrow 59 (FIG. 1). The resilient flexibility of the upper cover panel 56 allows it to be flexed without adversely permanently deforming the cover 56. It is contemplated that the present invention also includes a cover that is not flexible, but instead that is intended to simply be slid along the face of its respective panel frame until the cover can be removed or snapped perpendicularly off of the face of the partition frame 79. A resilient flap 119 is attached to a top of selected covers 56 to close the gap between cover 56 and the upper aesthetic cover 54, so as to prevent visual access and/or light through the gap.

Figure 24:
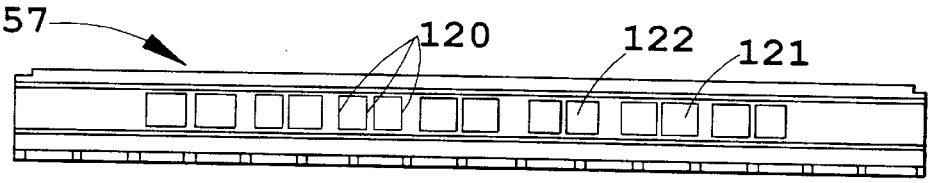
FIG. 24 is a front view of the lower beltway cover.
Figure 15A:
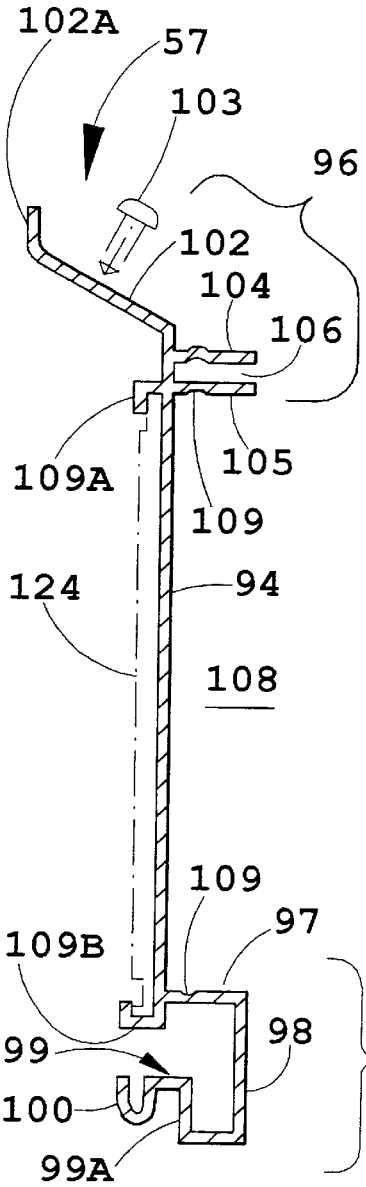
Figure 25:
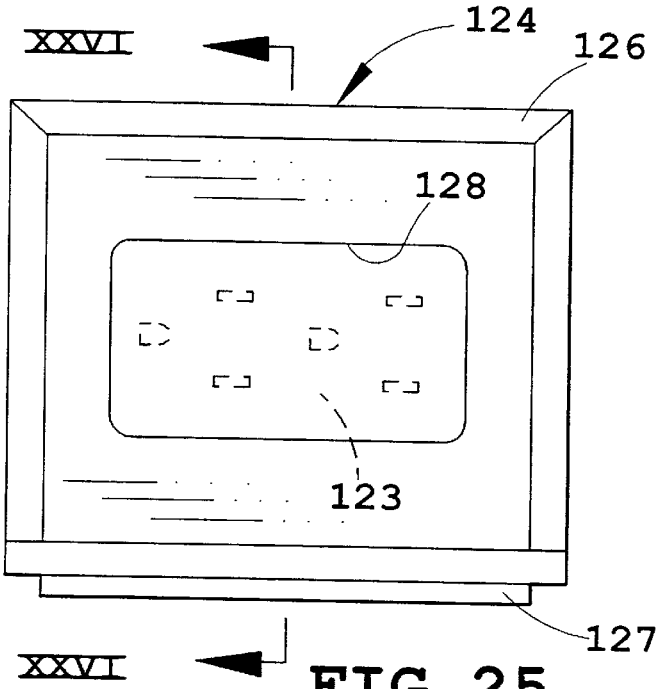
FIG. 25 is a front view of a secondary cover attachable to a rear of a lower beltway cover for matingly receiving/engaging a duplex electrical outlet.
Figure 26:
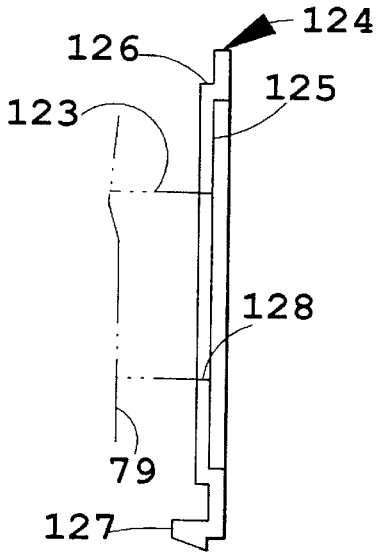
FIG. 26 is a cross sectional view taken along the line XXVI—XXVI in FIG. 25.
Figure 27:
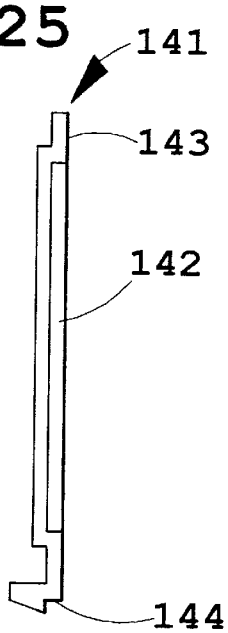
FIG. 27 is a front view showing another secondary cover for covering an aperture, such as is left when the secondary cover shown in FIG. 25 is removed.
Figure 16A:
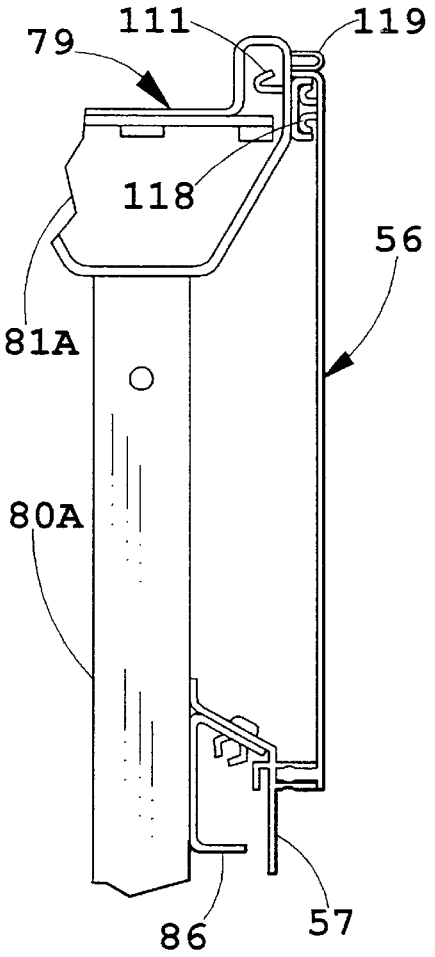
Figure 28:
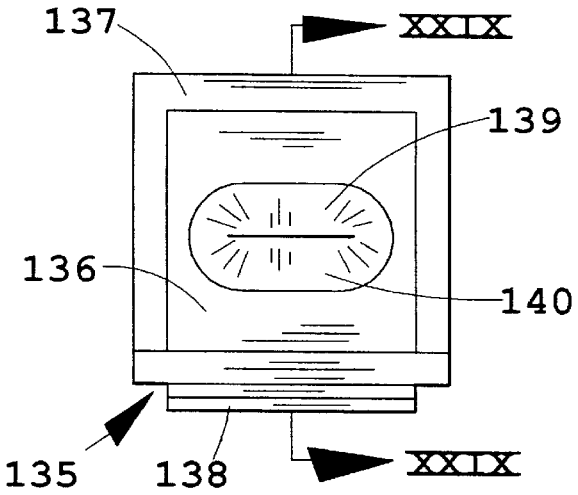
FIG. 28 is a front view showing a third secondary cover having a flexible member with a slit therein for passing wires therethrough.
Figure 30:
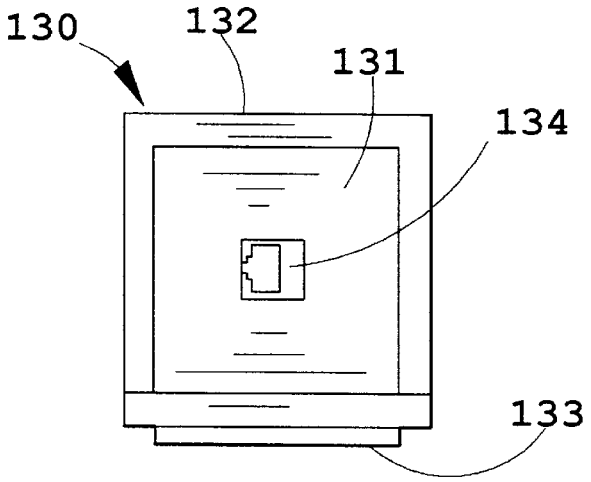
FIG. 30 is a front view of a fourth secondary cover including a telecommunication jack supported thereon.
Figure 29:
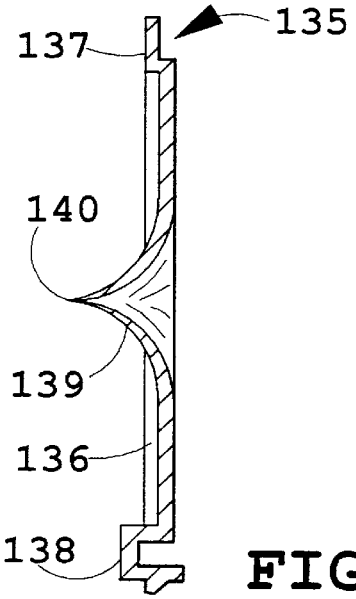
FIG. 29 is a cross section taken along the line XXIX—XXIX in FIG. 28.

It is contemplated that covers 56 and 57 can be redesigned so that they are reversed and/or inverted. For example, cover 56 could be redesigned so that it is the lower cover and so that cover 57 is the upper cover. The lower cover 57 (FIG. 24) includes a plurality of pre-cut scribe lines 120 cut into a back surface of panel body 94. These scribe lines 120 can be cut by blades, dies, knives, or water jets, or by other ways of cutting known in the art. The scribe lines 120 allow sections 121 to be selectively punched out of cover 57 to form apertures 122. Pairs of punchout sections 121 are defined along the length of body panel 94. Utility modules such as duplex 123 (FIG. 11 and 25) are attached to and supported on frame 79. Apertures 122 corresponding to the duplexes 123 are formed by selectively punching out sections 121 to align with the duplexes 123. A plurality of different secondary covers are attachable to cover 57 to cover the apertures 122 in a manner for receiving or providing routing of utilities through the apertures 122. For example, the secondary cover 124 (FIGS. 25 and 26) includes a generally planar body 125 with top and bottom edges 126 and 127 configured to snap into flanges 109A and 109B (FIG. 15A). (It is contemplated that the secondary covers could also be configured to snap into depressions 109 in the front of cover 57.) An aperture 128 is formed in the planar body 125 for matingly receiving the face 129 of a duplex 123. The aperture 128 can also be sized to mate with a simplex or other utility outlet. Another secondary cover 130 (FIG. 30) includes a planar body 131 with top and bottom edges 132 and 133 shaped like secondary cover panel 124, except that a telephone jack outlet 134 is attached to the center of the planar body 131. Still another secondary cover 135 (FIGS. 28 and 29) also includes a planar body 136 with top and bottom edges 137 and 138 comparable to edges 126 and 127, but having an aperture in planar body 136 closed with a resiliently flexible member 139. The flexible member 139 includes a slit 140 for allowing wires to be routed therethrough. The flexible member 139 resiliently closes around any wire routed therethrough, thus providing an aesthetically light-blocking closure around the wires. An aperture-covering secondary cover 141 (FIG. 27) includes a planar body 142 with top and bottom edges 143 and 144 shaped comparably to edges 126 and 127. The planar body 142 does not include any apertures, but instead is constructed to closeout and cover up an aperture 122 that is no longer being used.

Figure 11:
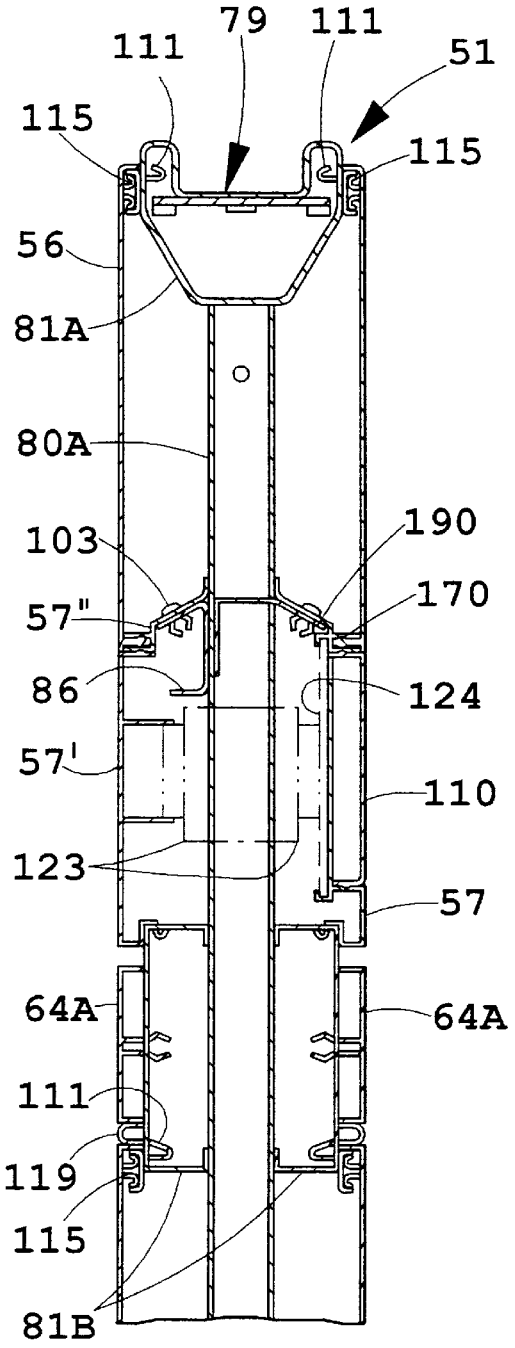
FIG. 11 is a fragmentary end view of an upper part of the partition shown in FIG. 5, the upper part beginning at about worksurface height and being located proximate the beltway area of the partition.
Figure 12:
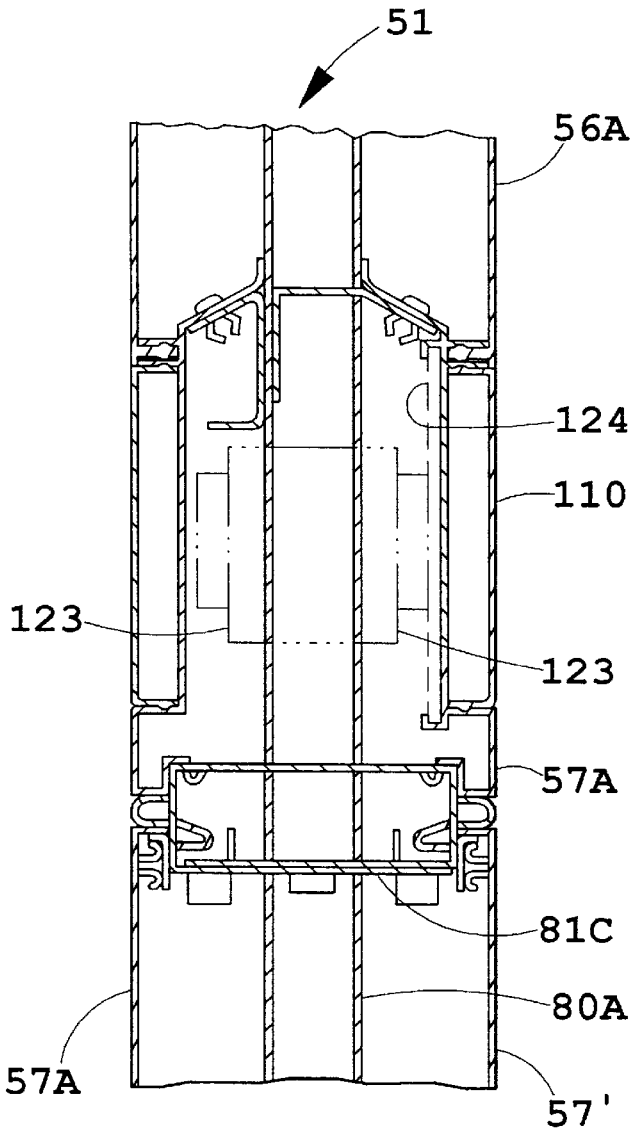
FIG. 12 is a fragmentary end view of another part of the partition shown in FIG. 5, the another part being spaced away from the beltway area.

It is noted that covers 53 and 54 can be replaced by a one-piece or two-piece cover 57' having an upper edge-like cover 56, a lower edge-like cover 57, and a center panel section with attachment flange 57", as shown in FIG. 11.

Figure 32:
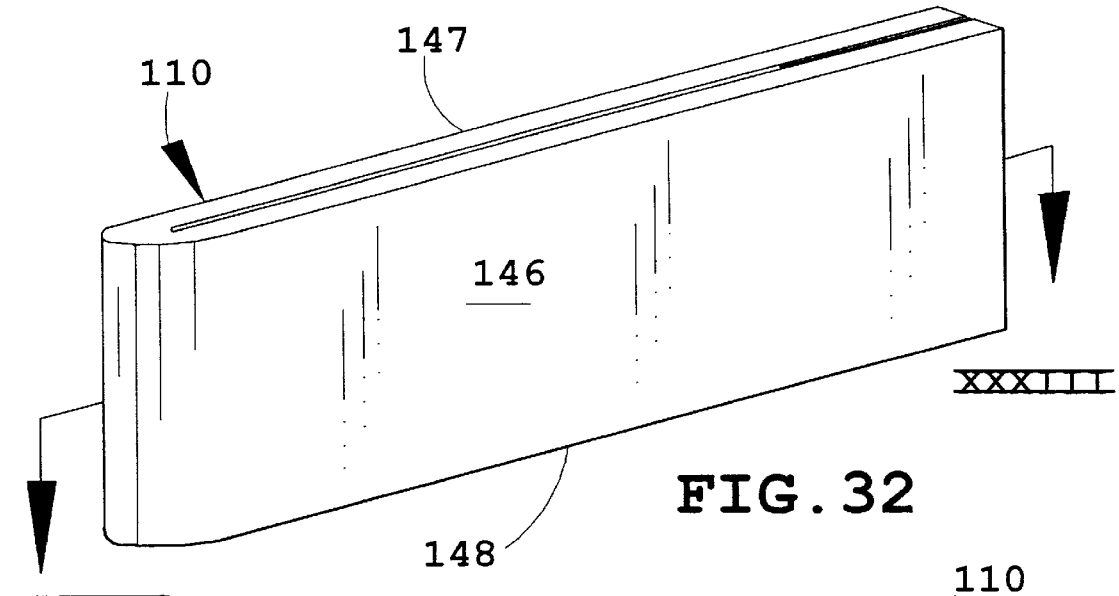
FIG. 32 is a perspective view of a wedge-shaped trim shoe attachable to a front of a lower beltway cover for covering a portion of the lower beltway cover.
Figure 33:
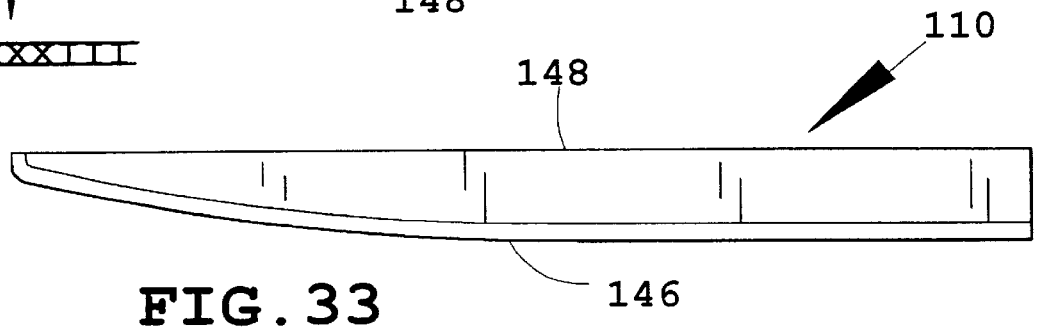
FIG. 33 is a cross section taken along the line XXI—XXI in FIG. 32.
Figure 34:
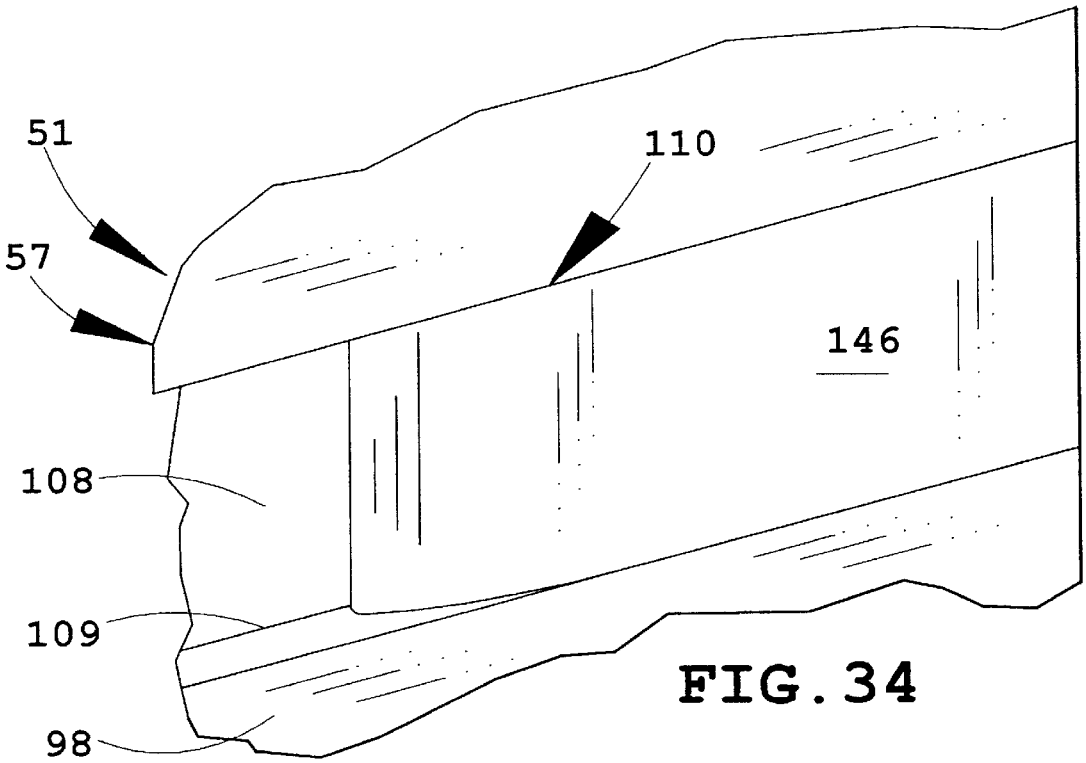
FIG. 34 is a fragmentary perspective view of the trim show of FIG. 32 installed in a lower beltway cover.

Another style close out device or shoe 110 is shown in FIGS. 32–34. The close out shoe 110 is wedge shaped, and includes an aesthetically shaped, curvilinearly shaped, front wall 146 with matingly shaped side flanges 147 and 148. The side flanges 147 and 148 include side ridges 149 shaped to frictionally engage the depressions 109 in lower cover 57. The shoe 110 can be slid along the recess 108 of beltway cover 57, such as to a location adjacent a perpendicularly attached "fin wall" partition panel 52. Thus, the trim shoe 110 provides an attractive appearance to the beltway covers 56 and 57 at "off-module" partition panels, yet allows use of a beltway cover with recess 108 so that utility access posts/sites are recessed closer to the center of frame 79.

Figure 31:
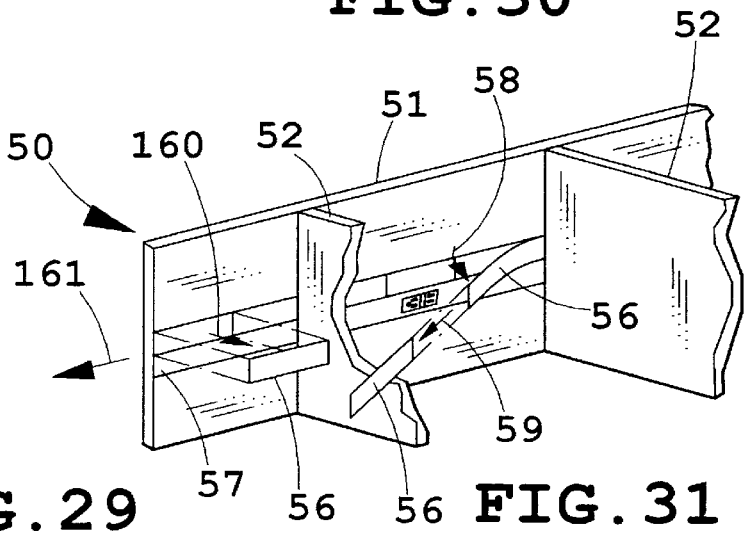
FIG. 31 is a schematic view showing removal of an upper beltway cover in order to access the area behind a lower beltway cover.
Figure 17:
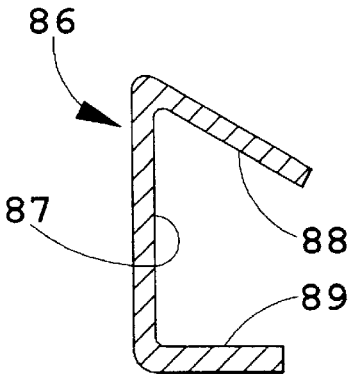
FIGS. 17 and 18 are side and perspective views of the C-shaped bracket shown in FIG. 11 attached to the partition frame for supporting beltway covers thereon.

As shown in FIG. 31, cover 56 can be removed by snappingly removing the cover 56 in a perpendicular direction 160, by sliding the cover 56 along the face of the partition 51 (or 52) in direction 161, or by flexing the cover 56 in direction 58 so that the cover 56 can be slidingly removed along direction 59.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A partition construction for subdividing a building space comprising:

a partition frame having an open interior with utilities therein and defining a front side;

a removable cover covering a section of the partition frame; and a cover support on the partition frame slidably supporting the cover for movement parallel the front side between a closed position covering the open interior and an open position providing access to the utilities in the open interior.

2. The partition construction defined in claim 1 including a second cover having a face with at least one aperture for receiving utility outlets connected to the utilities in the partition frame, and wherein the removable cover is positioned proximate the second cover so that, by moving the removable cover to the open position, access is provided to the utilities behind the second cover.

3. The partition construction defined in claim 2 wherein the removable and second covers include coplanar sections.

4. The partition construction defined in claim 2 wherein the removable cover is configured to disengage from the partition frame in a direction perpendicular to the front side of the partition frame.

5. The partition construction defined in claim 4 wherein the removable cover is semi-flexible and is configured to simultaneously slide along the partition frame and flex away from the partition frame to a disengaged/removed position.

6. The partition construction defined in claim 5 wherein the removable cover is positioned proximate a worksurface height, and including utilities located in the partition frame proximate the worksurface height.

7. The partition construction defined in claim 1 including a second partition frame having a vertical side edge positioned adjacent the removable cover, the second partition frame being attached to the first-mentioned partition frame at a location between vertical side edges of the first-mentioned partition frame so that the removable cover is prevented from perpendicular movement forwardly off of the first partition frame.

8. The partition construction defined in claim 1 wherein the cover support includes a clip attached to the partition frame and wherein the removable cover slidably engages the clip.

9. The partition construction defined in claim 8 wherein the clip snap attaches to the partition frame.

10. The partition construction defined in claim 1 wherein the removable cover is configured to selectively engage the cover support from a direction perpendicular the front side of the partition frame and also to engage the cover support from a direction parallel the front side of the partition frame.

11. The partition construction defined in claim 1 including a second cover positioned adjacent the removable cover, and including a plurality of secondary covers each shaped to selectively cover an aperture in the second cover.

12. The partition construction defined in claim 11 wherein the plurality of secondary covers includes a first secondary cover with a second aperture shaped to matingly receive one of a duplex power outlet and a simplex power outlet.

13. The partition construction defined in claim 12 wherein the plurality of secondary covers includes a second secondary cover having a telecommunication jack supported thereon.

14. The partition construction defined in claim 13 wherein the plurality of secondary covers includes a third secondary cover having a wire-receiving aperture for feeding wires therethrough.

15. The partition construction defined in claim 14 wherein the third secondary cover includes a flexible member substantially covering the wire-receiving aperture.

16. The partition construction defined in claim 2 wherein the second cover includes a ridge along a horizontal side edge, and wherein the removable cover includes a recess for receiving the ridge for snap attachment of the removable cover to the second cover.

17. The partition construction defined in claim 2 wherein the second cover includes a recessed planar section having apertures therein.

18. The partition construction defined in claim 17 wherein the recessed planar section is concavely shaped and extends into the open interior.

19. The partition construction defined in claim 2 wherein the second cover has a utility-supporting region and lines scribed into the region so as to define punchouts of predetermined size, the punchouts being configured to be selectively punched out to form the at least one apertures in desired locations.

20. The partition construction defined in claim 2 including a plurality of secondary covers configured for attachment to the second cover over the at least one aperture, the plurality of secondary covers being configured to receive utility outlets connected to different utilities in the partition frame.

21. The partition construction defined in claim 20 wherein the secondary covers snap attach to the second cover.

22. The partition construction defined in claim 20 wherein the secondary covers include at least a first secondary cover with a particular aperture shaped to receive a duplex outlet, a second secondary cover with a telecommunication jack therein, and a third secondary cover adapted to cover the at least one aperture.

23. A partition construction comprising:

a partition frame having a front and an interior space with utilities therein;

a first beltway cover attached to the partition frame, the first beltway cover including a section adapted to receive utility outlets connected to the utilities; and a second beltway cover attached to the partition frame adjacent the first beltway cover, the second beltway cover being slidably attached to the partition frame and being moveable along the front to provide access to the utilities in the interior space at a back of the first beltway cover.

24. The partition construction defined in claim 23, wherein the second beltway cover is resiliently flexible and is configured to simultaneously slide and flex when the second beltway cover is being removed from the partition frame.

25. The partition construction defined in claim 23 including a second partition frame attached to the first-mentioned partition frame between vertical side edges of the first-mentioned partition frame, the second partition frame having a vertical side edge located proximate the front of the first-mentioned partition frame such that the second beltway cover cannot be removed from the first-mentioned partition frame in a direction perpendicular the front of the first-mentioned partition frame.

26. The partition construction defined in claim 23 including a clip attached to the partition frame for slidably supporting the second beltway cover.

27. The partition construction defined in claim 26 wherein the clip has a pair of resilient arms defining a pocket, and wherein the second beltway cover includes a ridge shaped to engage the pair of resilient arms in a manner allowing the second beltway cover to slide horizontally on the slip parallel the front and allowing the second beltway cover to snappingly engage the clip perpendicular the front.

28. The partition construction defined in claim 23 wherein the first and second beltway covers include abutting edges, one of the edges including a ridge and the other including a recess for snappingly engaging the ridge.

29. A cover construction for covering a partition frame with utilities therein comprising:

a first cover having a face adapted to receive utility outlets, a first horizontal side edge, and a front; and a removable second cover having a second horizontal side edge configured to matingly engage the first horizontal side edge, the second cover slidably engaging the first horizontal side edge for movement along the face to a disengaged position to provide access to utilities behind the first cover.

30. The cover construction defined in claim 29, including a clip for attachment to the partition frame for slidably supporting the second cover panel on the partition frame.

31. The cover construction defined in claim 30, wherein the clip has a horizontally continuous cross section.

32. The cover construction defined in claim 31, wherein the first and second horizontal side edges include a ridge and mating recess, respectively.

33. The cover construction defined in claim 31, wherein the first cover includes a region having a plurality of scribe lines defining punchouts that, when removed, define apertures for routing utilities therethrough.

34. The cover construction defined in claim 31, wherein the first cover includes at least one aperture for routing utilities therethrough, and including a plurality of secondary covers shaped to selectively attach to the first cover to cover the at least one aperture.

35. The cover construction defined in claim 34 wherein at least one of the secondary covers includes a secondary aperture for routing wiring therethrough with a flexible member at least partially covering the secondary aperture.

36. The cover construction defined in claim 34 wherein at least one of the secondary covers includes a closeout cover for closing the at least one aperture.

* * * * *